US009061528B2

(12) United States Patent
Lee

(10) Patent No.: US 9,061,528 B2
(45) Date of Patent: Jun. 23, 2015

(54) MARKING AND/OR CODING

(75) Inventor: Daniel John Lee, Knapwell (GB)

(73) Assignee: Domino Printing Sciences PLC (GB)

( * ) Notice: Subject to any disclaimer, the term of this patent is extended or adjusted under 35 U.S.C. 154(b) by 776 days.

(21) Appl. No.: 12/447,371

(22) PCT Filed: Oct. 26, 2007

(86) PCT No.: PCT/GB2007/004123

§ 371 (c)(1),
(2), (4) Date: Jan. 19, 2010

(87) PCT Pub. No.: WO2008/050147

PCT Pub. Date: May 2, 2008

(65) Prior Publication Data

US 2010/0110125 A1 May 6, 2010

(30) Foreign Application Priority Data

Oct. 27, 2006 (GB) ..... 0621375.5

(51) Int. Cl.
*B41J 29/38* (2006.01)
*B41J 11/00* (2006.01)

(52) U.S. Cl.
CPC ..... *B41J 11/007* (2013.01); *B41J 11/008* (2013.01)

(58) Field of Classification Search
USPC ..... 347/14, 1, 5, 9, 16, 15; 388/812
See application file for complete search history.

(56) References Cited

U.S. PATENT DOCUMENTS

| | | | | |
|---|---|---|---|---|
| 3,361,949 | A * | 1/1968 | Brown et al. | 388/812 |
| 5,589,858 | A * | 12/1996 | Kadowaki et al. | 347/14 |
| 5,719,602 | A | 2/1998 | Hackleman et al. | |
| 6,601,938 | B1 | 8/2003 | Iwasaki et al. | |
| 7,175,246 | B2 * | 2/2007 | Niekawa et al. | 347/14 |
| 2005/0151770 | A1 | 7/2005 | Takeuchi | |
| 2006/0170723 | A1 * | 8/2006 | Thiessen et al. | 347/16 |
| 2006/0221164 | A1 | 10/2006 | Nakashima | |

FOREIGN PATENT DOCUMENTS

| | | |
|---|---|---|
| DE | 10 2004 025140 | 12/2005 |
| EP | 1683639 | 7/2006 |

* cited by examiner

*Primary Examiner* — Lam Nguyen
(74) *Attorney, Agent, or Firm* — Price Heneveld LLP

(57) ABSTRACT

The invention provides a marking and/or coding apparatus which allows print resolution to be adjusted by multiplying or dividing encoder inputs generated from a conveyor on which goods to be coded or marked are transported to a marking station.

2 Claims, 4 Drawing Sheets

Figure 1:
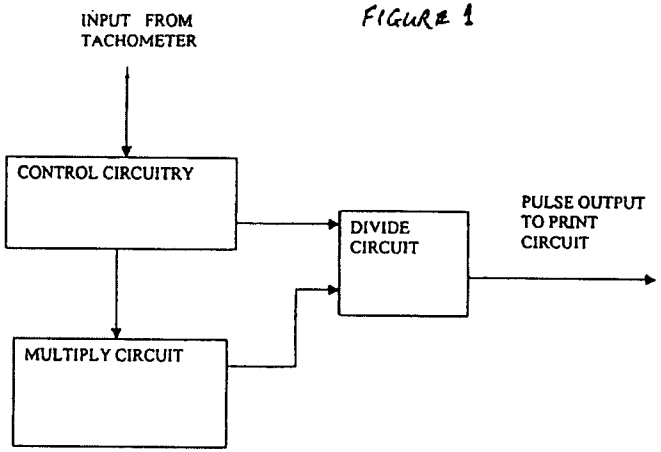

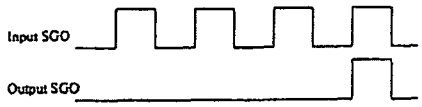
FIGURE 2.
FIGURE 3.
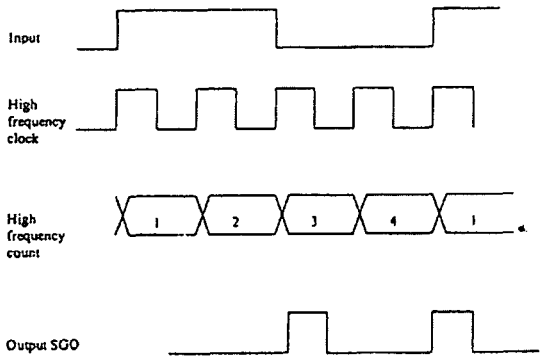

MARKING AND/OR CODING

FIELD OF THE INVENTION

This invention relates to marking and/or coding and has been developed, in particular, for application to industrial and/or commercial marking and coding equipment.

BACKGROUND OF THE INVENTION

Industrial marking and coding equipment is used to mark and/or code products. This type of equipment is, by its nature, non-contact. In other words, there is no direct contact either between the mark or code-applying device and the substrate to which the mark or code is applied or between the mark and code-applying device and the conveyor on which the substrate is delivered past the applying device. Accordingly, there must be careful synchronization between movement of the substrate and operation of the mark or code-applying device to ensure the correct mark or code is clearly applied to the substrate.

Typically, the substrate to be marked is the surface of a product positioned on a moving conveyor line. The marking or coding equipment is fixed in position alongside the line and applies the mark to the product as the product passes the marking equipment. In order to ensure correct placement of the mark, the spacing between products is controlled or monitored, as is the speed of the conveyor line. To this end, a sensor, typically but not necessarily a rotary optical encoder, is linked to the conveyor line and outputs pulses. These pulses are then used to trigger the operation of the marking device. Thus, the operation of the marking device is always fixed in ratio to the speed of the production line.

The resolution of the required printed image must be matched correctly to the number of pulses provided by the sensor, otherwise the image will appear either expanded or compressed. Often the sensor will have a limited degree of mechanical adjustment to enable matching of the print resolution. In some applications the diameter of the drive attached to the encoder may have to be changed to either speed up or slow down the rotation of the rotary sensor with respect to the line. Alternatively, or in addition, the rotary sensor may have to be substituted by one giving a greater or lesser number of pulses per revolution.

Setting up the sensor to optimize print resolution can therefore require considerable time and skilled operator intervention.

It will be appreciated that one production line may be used to process a variety of products, each of which may require different print resolutions. Alternatively, or in addition, marking equipment may be swapped between production lines to service marking applications having different print resolutions. In both cases the setting-up exercise, described above, has to be followed.

It is an object of this invention to provide a method and/or apparatus which will go at least some way in addressing the aforementioned problems; or which will at least offer a novel and useful alternative.

SUMMARY OF THE INVENTION

Accordingly, in one aspect, the invention provides a method of modifying the application of print to a substrate moving along a line, said method including generating a first speed signal from movement of said line and generating a print command signal related in frequency to said first speed signal, said method being characterized in that said speed signal is altered electronically before being applied to the creation of a print command signal.

In a second aspect the invention provides a print application apparatus operable to apply print to a substrate moving past the apparatus on a line, said apparatus including means to receive a first speed signal generated from the movement of said line; said apparatus being characterized in that it includes an alteration facility operable to generate, electronically, a print command signal related in frequency to said first speed signal.

In a third aspect the invention provides a method of setting the resolution of print applied to a substrate moving on a line past a print application device, wherein said print application device outputs a printing operation in response to a speed signal generated from movement of said line, said method being characterized in that said speed output signal is subjected to electronic alteration before receipt by said print application device.

Preferably, different settings for electronically altering said speed signal for particular different printing jobs are determined and stored in memory.

In a fourth aspect, the invention provides a print application apparatus operable to apply print to a substrate moving on a line past said apparatus, wherein said apparatus outputs a print operation in response to a speed signal generated from movement of said line, said apparatus being characterized in that it includes a print resolution setting facility wherein said speed signal is increased or decreased electronically before triggering a print operation.

Many variations in the way the present invention can be performed will present themselves to those skilled in the art. The description which follows is intended as an illustration of only one means of performing the invention and the lack of description of variants or equivalents should not be regarded as limiting. Wherever possible, a description of a specific element should be deemed to include any and all equivalents thereof whether in existence now or in the future.

Figure 4:
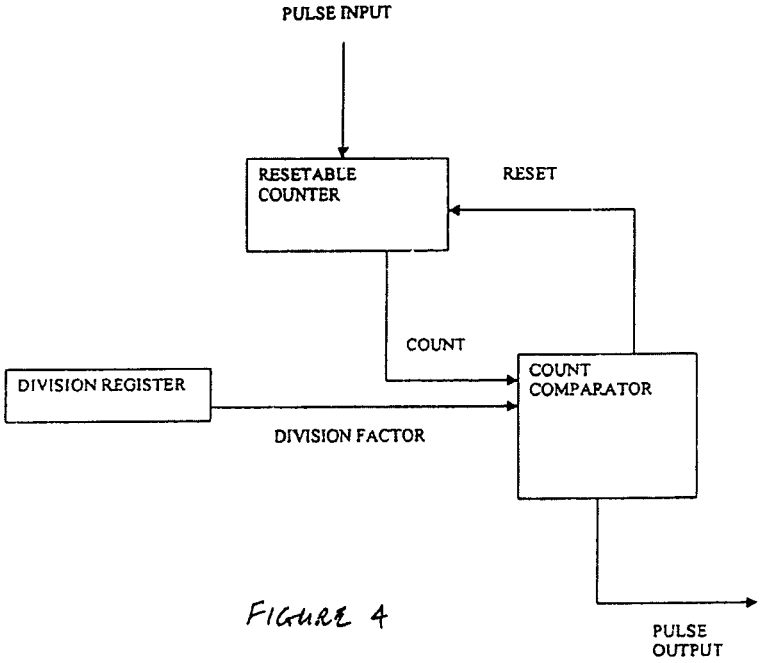
Figure 5:
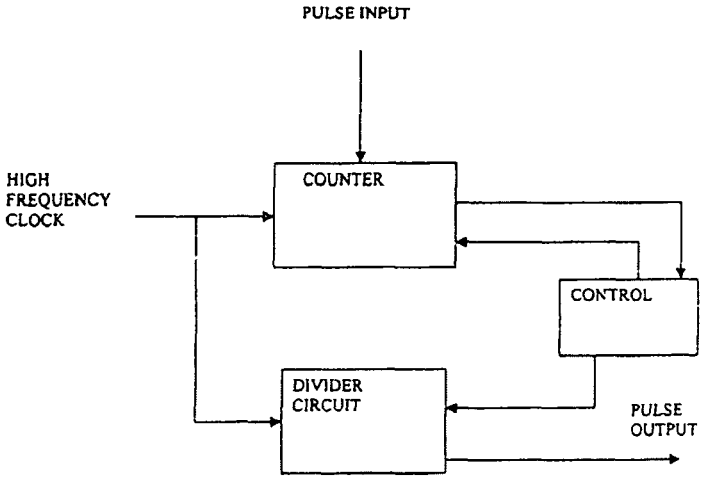

An embodiment of the invention will now be described with reference to the accompanying drawing in which:

FIG. 1: shows a schematic diagram of a marking and coding apparatus incorporating the various aspects of the invention;

FIG. 2: shows waveforms illustrating a divide operation performed by the apparatus of FIG. 1;

FIG. 3: shows waveforms illustrating a multiply operation performed by the apparatus of FIG. 1;

FIG. 4: shows a schematic sequence of the steps involved in a divide operation; and FIG. 5: shows a schematic sequence of the steps involved in a multiply operation.

DESCRIPTION OF WORKING EMBODIMENT

The invention described herein, in its various aspects, provides a method and apparatus for easily and simply setting up marking and/or equipment and, in particular, to allow print resolution to be easily and quickly adjusted.

Hereinafter the term "marking" will be used, the term being intended to mean any form of marking including the application of codes. Such marking may be affected by any known technique applied to the marking of unit items delivered past a marking station on a moving line. Known techniques specifically include continuous inkjet printers, drop on-demand inkjet marking devices, and laser marking devices.

Referring to FIG. 1, an overall system outline is shown for a mark-applying apparatus according to the invention. A signal input is provided from an encoder or tachometer driven by the moving line in the form of a pulse train. As is well known, the frequency of pulses within the train is proportional to the speed of the line. According to the invention, this input pulse train is subjected to digital processing which multiplies or divides the incoming pulse signals and generates commands which trigger the application of lines of print onto products carried by the line. "Print," in this context, is intended to include marking applied by the application of inks and lasers.

As can be seen, the basic pulse train, which is derived mechanically from movement of the line, is first passed to a control circuit. This control circuit includes a provision for a plant operator to select whether the frequency of the basic pulse train is to be multiplied or divided. The operator can also select the multiplication or division ratio. Alternatively, as described below, the operator can select from settings stored in memory a desired print resolution, and implement this setting.

If the election is to divide the basic pulse train so as to slow the frequency of print commands, the pulse train is directed to the Divide Circuit and processed in the manner described below. Following division, the output pulse is directed to the print circuit where the pulses trigger the application of individual print strokes.

If the decision is made to multiply the pulse train so as to increase the frequency of print commands, the pulse train is directed to the Multiply Circuit and processed in the manner described below. It will be apparent from the description below that the multiply step described herein involves a final divide step, hence the layout depicted in FIG. 1.

Referring now to FIG. 2, the basic pulse train is shown as Input SGO. Following division by, in this instance four, Output SGO is generated. One technique for affecting the division is shown in FIG. 4. The Division Factor is operator determined and controls the Count Comparator. Incoming pulses (whether in the form of the basic pulse train or from the multiplying circuit) are counted by a Resetable Counter. The counts are then compared by the Count Comparator and, each time the count equals the stored number, a pulse is outputted to the print circuit, and the Resetable Counter is reset.

Turning now to FIG. 5, for pulse multiplication, a high frequency clock is preferably employed. The clock output is fed into a counter and the number of clock cycles for each pulse of the basic pulse train determined. The high frequency count is then applied to the divide circuit, along with the appropriate division ratio, to achieve the desired output pulse frequency. This is shown schematically in FIG. 3.

It will be appreciated that the present invention not only provides a quick and efficient method and apparatus for adapting an essentially mechanical set-up to suit different marking jobs, it also provides a quick and efficient method of altering print resolution. To further enhance the invention as described, multiplication/division settings for different job requirements can be stored in memory and accessed by an operator, from an appropriate menu, each time a particular print job is repeated.

It will thus be appreciated that the present invention, at least in the case of the working embodiment herein described, provides a method and/or apparatus which minimize operator intervention and time when setting up a marking apparatus between different print jobs.

What is claimed is:

1. A method of setting the print resolution of a printer applying print to a substrate moving on a line past the printer at a speed not under the control of said printer, said method comprising the steps of:

mechanically deriving a pulse train from movement of said line, said pulse train having a frequency;

using an electronic control circuit to multiply and divide said frequency to establish a plurality of different multiplication ratios and a plurality of different division ratios;

storing said different multiplication and division ratios in an electronic memory forming part of said electronic control circuit and attributing a print resolution setting to each of said ratios; and manually selecting from said electronic memory a print resolution setting for a particular print job.

2. A printer operable to apply print to a substrate moving on a line past the printer at a speed not under the control of said printer, said printer comprising an electronic control circuit operable to:

receive a pulse train having a frequency, said pulse train being derived mechanically from movement of said line;

both multiply and divide said frequency to establish a plurality of different multiplication ratios and a plurality of different division ratios; and store in a memory forming part of said electronic control circuit, a print resolution setting attributed to each of said different multiplication and division ratios, wherein said memory is manually accessible to allow the selection of a print resolution setting for a particular print job.

* * * * *